US007306363B2

(12) United States Patent
Manke

(10) Patent No.: US 7,306,363 B2
(45) Date of Patent: Dec. 11, 2007

(54) CONTAINER HOLDER PLATFORM

(75) Inventor: Scott G. Manke, Sun Prairie, WI (US)

(73) Assignee: Masterchem Industries LLC, Imperial, MO (US)

( * ) Notice: Subject to any disclaimer, the term of this patent is extended or adjusted under 35 U.S.C. 154(b) by 41 days.

(21) Appl. No.: 10/768,846

(22) Filed: Jan. 30, 2004

(65) Prior Publication Data

US 2005/0169102 A1 Aug. 4, 2005

(51) Int. Cl.
*B01F 11/00* (2006.01)

(52) U.S. Cl. ..... 366/214; 366/605

(58) Field of Classification Search ..... 366/211, 366/213–217, 605

See application file for complete search history.

(56) References Cited

U.S. PATENT DOCUMENTS

| | | | | | |
|---|---|---|---|---|---|
| 423,362 | A | * | 3/1890 | Wells | 366/214 |
| 2,006,451 | A | | 7/1935 | Glidden | |
| 2,022,527 | A | | 11/1935 | Schletz | |
| 2,060,932 | A | | 11/1936 | Friermood | |
| 2,612,204 | A | * | 9/1952 | Rickhoff et al. | 72/119 |
| 2,721,106 | A | * | 10/1955 | Chaney | 108/147 |
| 2,915,640 | A | | 12/1959 | Grubel et al. | 250/108 |
| 2,918,063 | A | * | 12/1959 | Tucker | 604/157 |
| 3,301,534 | A | | 1/1967 | Orser | |
| 3,997,092 | A | * | 12/1976 | Pogwizd | 224/610 |
| 4,004,783 | A | | 1/1977 | Wilson | |
| 4,114,196 | A | | 9/1978 | Lostutter | 366/348 |
| 4,118,801 | A | | 10/1978 | Kraft et al. | 366/111 |
| 4,265,548 | A | | 5/1981 | Hall | 366/208 |
| 4,329,068 | A | | 5/1982 | Neumer et al. | 366/214 |
| 4,398,829 | A | | 8/1983 | Shick | 366/110 |
| 4,445,782 | A | | 5/1984 | Sparrow | 366/217 |
| 4,497,581 | A | | 2/1985 | Miller | 366/208 |
| 4,747,693 | A | | 5/1988 | Kahl | 366/208 |
| 4,788,438 | A | | 11/1988 | Evers | 250/506.1 |
| 5,197,802 | A | | 3/1993 | Miller et al. | 366/217 |
| 5,215,195 | A | | 6/1993 | Williams | 206/446 |
| 5,268,620 | A | * | 12/1993 | Hellenberg | 318/114 |
| 5,439,287 | A | | 8/1995 | Roepke | 366/130 |
| 5,749,652 | A | | 5/1998 | Brunn et al. | |
| 5,788,371 | A | | 8/1998 | Neri et al. | 366/217 |
| 6,302,575 | B1 | | 10/2001 | Anderson et al. | 366/349 |
| 6,679,398 | B1 | | 1/2004 | O'Brien | 220/495.02 |
| 6,945,690 | B2 | * | 9/2005 | Armendariz et al. | 366/209 |
| 6,960,012 | B1 | * | 11/2005 | Biber | 366/110 |
| 6,988,824 | B2 | * | 1/2006 | Santospago et al. | 366/217 |
| 2004/0008573 | A1 | | 1/2004 | MacDonald et al. | 366/209 |

* cited by examiner

*Primary Examiner*—David Sorkin
(74) *Attorney, Agent, or Firm*—Foley & Lardner LLP

(57) ABSTRACT

A method and a system for holding and mixing a first container of paint having a first volume and a second container of paint having a second volume less than the first volume. The system comprises a holder comprising a clamp having a plate configured to apply pressure to the first container. A motor is configured to move the holder about at least one axis. The platform is configured for being removably placed within the holder and configured to hold the second container. Another embodiment of the system includes a stop placed proximate an edge of the platform.

19 Claims, 4 Drawing Sheets

CONTAINER HOLDER PLATFORM

BACKGROUND AND FIELD

The present invention relates generally to the field of mixers, and more particularly to a method and apparatus for accommodating containers of different sizes in a mixer.

Mixers, for example, paint shakers, are used to mix paint prior to sale of the paint and/or prior to use to ensure homogenous mixture of the paint components that may have separated. Additionally, paint shakers are used to thoroughly mix a tint or colorant to the paint to add and/or change the color of the paint.

One apparatus used for shaking paint employs a top plate and a bottom plate that is moved toward and compresses the paint container between the plates. The plates then move in unison in an up and down direction to thoroughly mix the paint. When a color additive is added to the container by first removing the lid, the compression of the two plates ensures that the paint container lid and cap remain secured to the container body. In this way, no paint can be spilled from the container as the container is moved up and down. The plates move up and down relative to one another along a vector that is perpendicular to both of the plates. The top plate is moved up sufficiently to allow the paint container to be removed. Typically, the container is loaded into the shaker between the top and bottom plates in a direction that is parallel to the two plates defined by the top and bottom plates. The top and bottom plates typically are configured to accommodate at least four containers.

Such known shakers are typically configured for use with a single sized container of paint such as a one gallon (4 liter) container of paint. However, such known shakers are not well adapted for use with other size containers of paint, such as one quart container (1 liter) of paint. Nor are such shakers well suited for mixing, at the same time, the contents of two different sized containers. It is known to use an adapter with such known shakers. Such adapters typically are configured to have the smaller size container inserted into the adapter and then placed in the shaker. Such arrangement requires additional equipment for use with the shaker and typically are as bulky as a gallon container of paint.

Thus, there is a need for a system for holding and mixing a first container of paint having a first volume and a second container of paint having a second volume less than the first volume. There is also a need for a method of accommodating containers of different sizes in a paint mixer for holding and mixing containers of paint.

SUMMARY

There is provided a system for holding and mixing a first container of paint having a first volume and a second container of paint having a second volume less than the first volume. The system comprises a holder comprising a clamp having a plate configured to apply pressure to the first container. A motor is configured to move the holder about at least one axis. The platform is configured for being removably placed within the holder and configured to hold the second container. Another embodiment of the system includes a stop placed proximate an edge of the platform.

There is also an apparatus for holding and mixing a first container of paint and a different size second container of paint. The apparatus includes a holder comprising a clamp having a plate configured to apply pressure to the containers. A motor configured to move the holder about at least one axis. A platform configured for removable placement within the holder below the second container, wherein the second container is positioned to allow the plate to apply pressure to both containers during a single mixing operation.

There is also provided an apparatus for holding and mixing a first container of paint having a first volume and a second container of paint having a second volume less than the first volume. The apparatus comprises a means for holding comprising a means for clamping to apply pressure to the first container. A means for moving configured to move the means for holding about at least one axis. A means for adjusting height is configured for being removably placed within the means for holding and configured to hold the second container. The means for adjusting height can also be configured to include a means for stopping.

DETAILED DESCRIPTION OF EXEMPLARY EMBODIMENTS

Figure 1:
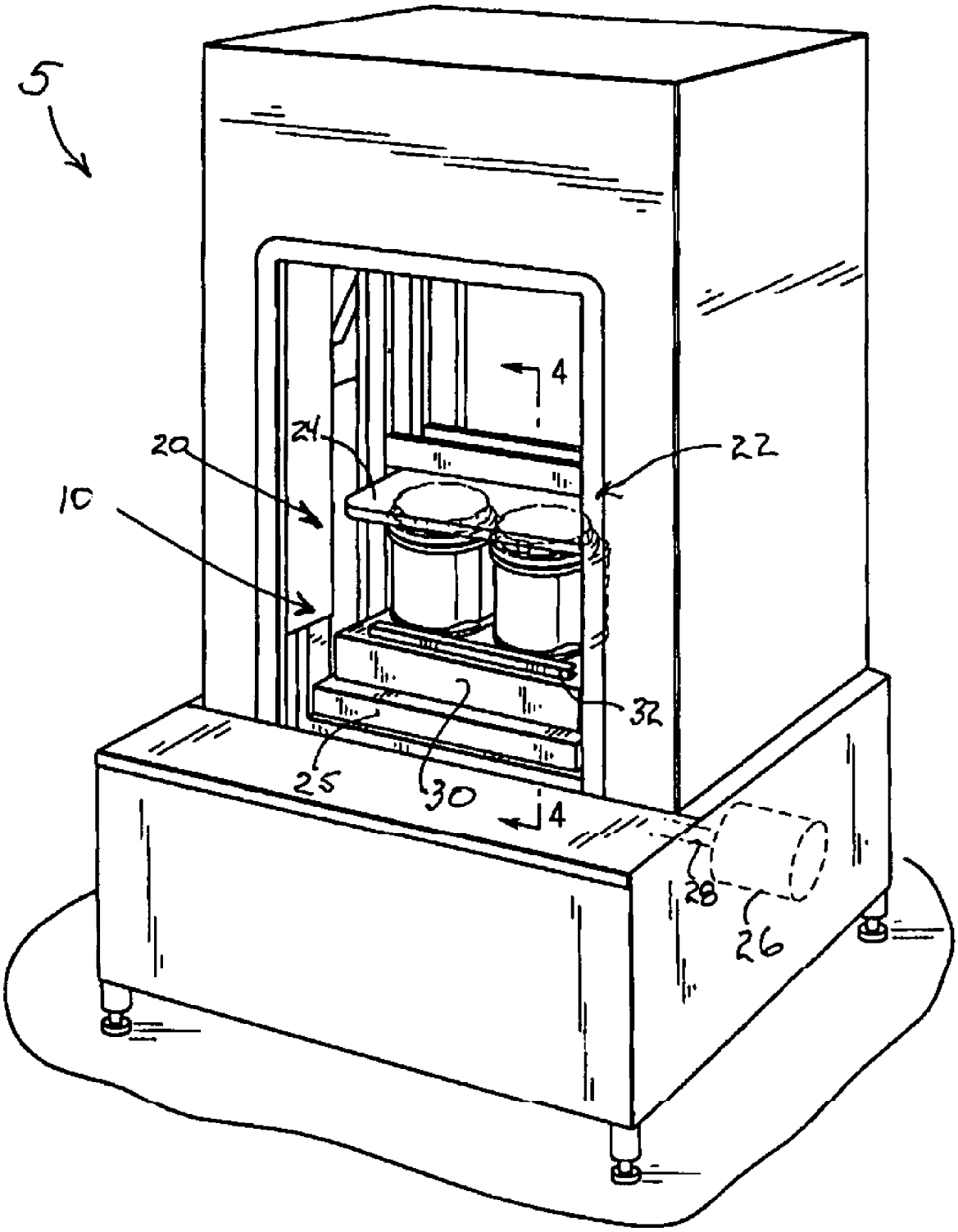
FIG. 1 is a perspective view of an exemplary embodiment of a paint mixer including a system for holding and mixing different size containers.

Referring to the figures, FIG. 1 illustrates a fluid mixing apparatus 5, for example to mix paint or similar coatings. The mixer 5 includes a system for holding 10 containers. A motor 26 is coupled to the system for holding 10 by conventional and convenient means, with controls to operate the mixer 5 in a predetermined manner.

The system 10 for holding and mixing is configured to accommodate a first container 12 having a first volume and a second container 14 having a second volume which is less than the first volume. An example of a fluid mixer 5, is an apparatus distributed by Fluid Management, Inc., a unit of Idex Corporation under Model Name 5G HD Mixer.

The mixer 5 typically contain the system for holding and mixing 10 within a housing or other suitable shroud. The system 10 for holding and mixing includes the holder 20 comprising a clamp 22 having a plate 24 configured to apply pressure to the containers. The motor 26 is configured to move the holder 20 about at least one axis 28 during the mixing process. A platform 30 is configured for being removably placed within the holder 20 and configured to support a second container 14.

FIG. 1 illustrates a mixer 5 having a system for holding and mixing 10 encased in a housing. The holder 20 includes a clamp 22 which is a plate 24 and a support member 25 between which the containers are placed. An apparatus, for example a hydraulic cylinder or a motor and screw arrangement moves the plate 24 to apply the pressure to the containers.

The system for holding and mixing 10 typically is configured to hold one to four containers. When all the containers are of the same size, equalized pressure can be applied to the containers during the mixing process. However, if containers of different sizes such as a first container 12 having the first volume and a second container 14 having a second volume that is less than the first volume, the plate 24 typically will only engage the larger, i.e., taller container. Such a situation requires two mixing procedures, one mixing procedure for the larger volume container and a second mixing procedure for the smaller, lesser volume container.

In order to mix the paint in containers of different sizes, a method of accommodating containers 12, 14 of different sizes in a paint mixer 5 for holding and mixing a first container 12 of paint having a first volume and a second container 14 of paint having a second volume less than the first volume is provided. The mixer 5 includes a holder 20 comprising a clamp 22 having a plate 24 configured to apply pressure to one of the containers 12, 14 and a motor 26 configured to move the holder 20 about at least one axis 28. The method comprises the steps of providing a removable platform 30 that will adjust the height of the holder 20 to accommodate the second container 14 during operation of the paint mixer 5. Placing the platform 30 in the holder 20 reduces the space between the plate 24 and the support member 25 of the clamp 22 in the mixer 5. Placing the second container 14 on the platform 30 and operating the paint mixer 5 in a predetermined manner. Such method allows a single mixing operation of two containers of different sizes.

The method can also include the step of balancing the holder 20 for both the first container 12 and the second container 14 supported by the platform 30 placed in the holder 20. For instance, two quart sized containers 14 could be placed on one side of the holder 20 and a single gallon size container 12 can be placed on the other side of the holder 20. Other arrangements of containers are contemplated as best determined by the operator of the mixer 5 at the time of the mixing operation.

Figure 3:
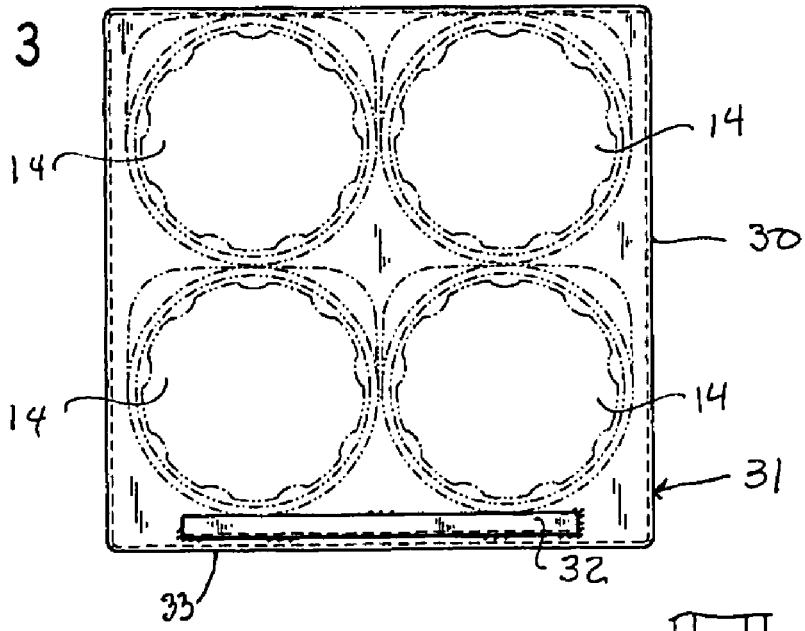
FIG. 3 is a top plan view of an exemplary embodiment of a platform of a system for holding and mixing containers configured to support four containers.

The platform 30 can be sized to accommodate different sized containers. For example, a platform 30 can be configured to support at least four containers. (See. FIG. 3.) A typical arrangement would be to support four second containers 14 which are smaller volume containers than the first container 12 size. For instance four-quart sized containers. However, if smaller sized containers are utilized, for instance a pint size container, the platform 30 can be configured to accommodate more containers, such as 8 containers. In any event, the perimeter 31 of the platform 30 is less than the perimeter of the holder 20. (See FIGS. 4 and 5.)

Figure 2:
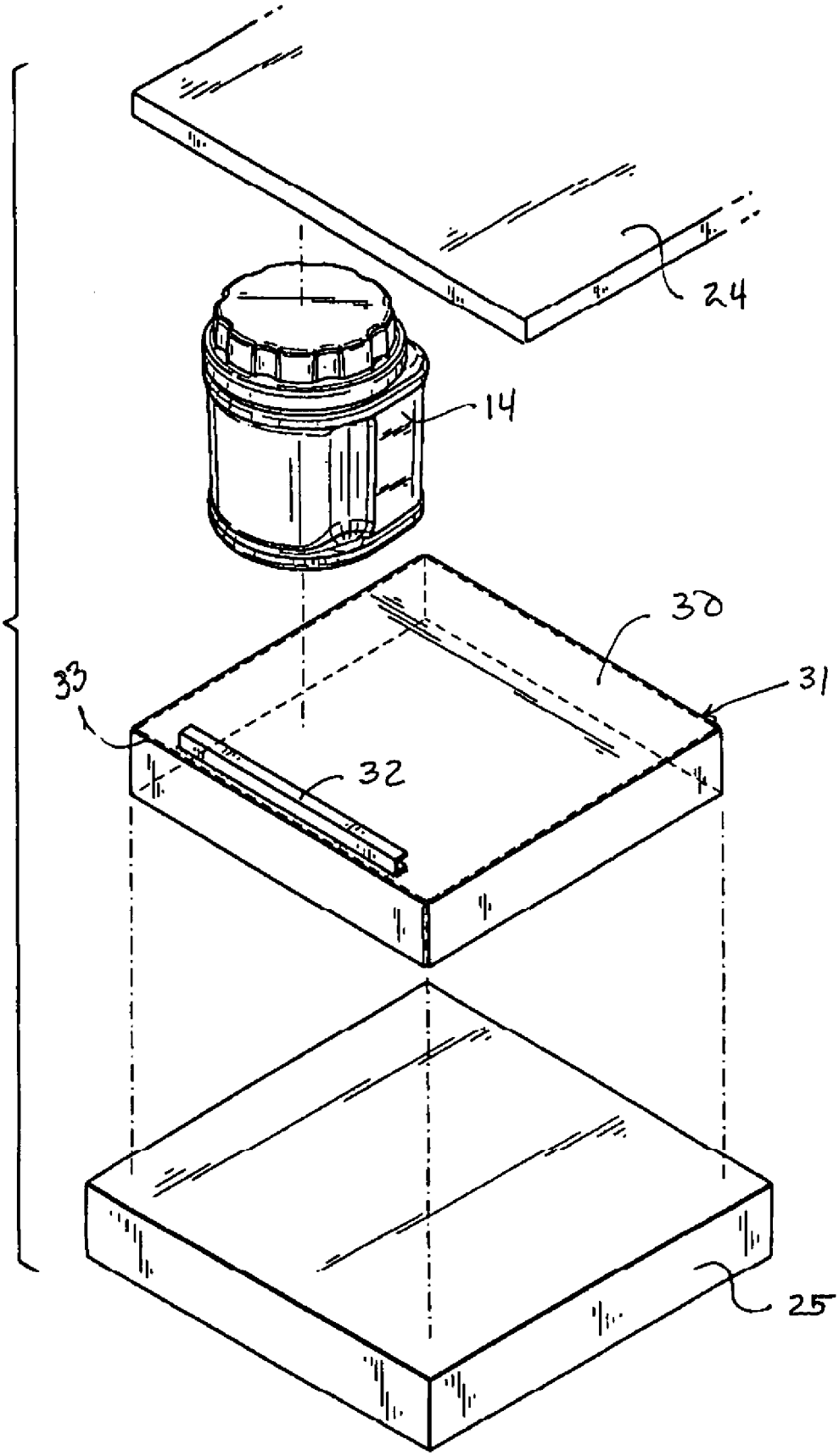
FIG. 2 is a partial perspective view of an exemplary embodiment of a system for holding and mixing containers of paint and illustrating a platform configured to support a quart sized container in a holder of a paint mixer.
Figure 4:
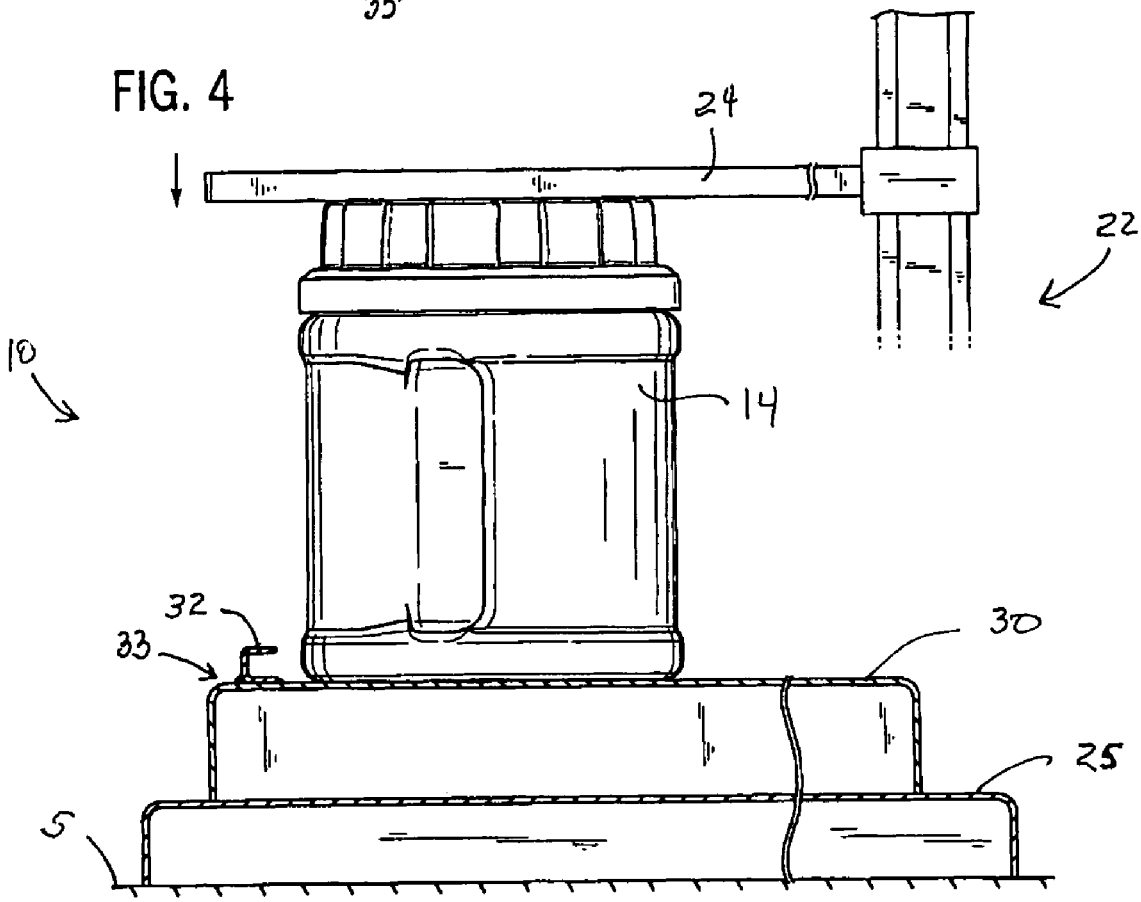
FIG. 4 is a partial sectional side view of a system for holding and mixing illustrated in FIG. 1 along the line 4-4.
Figure 5:
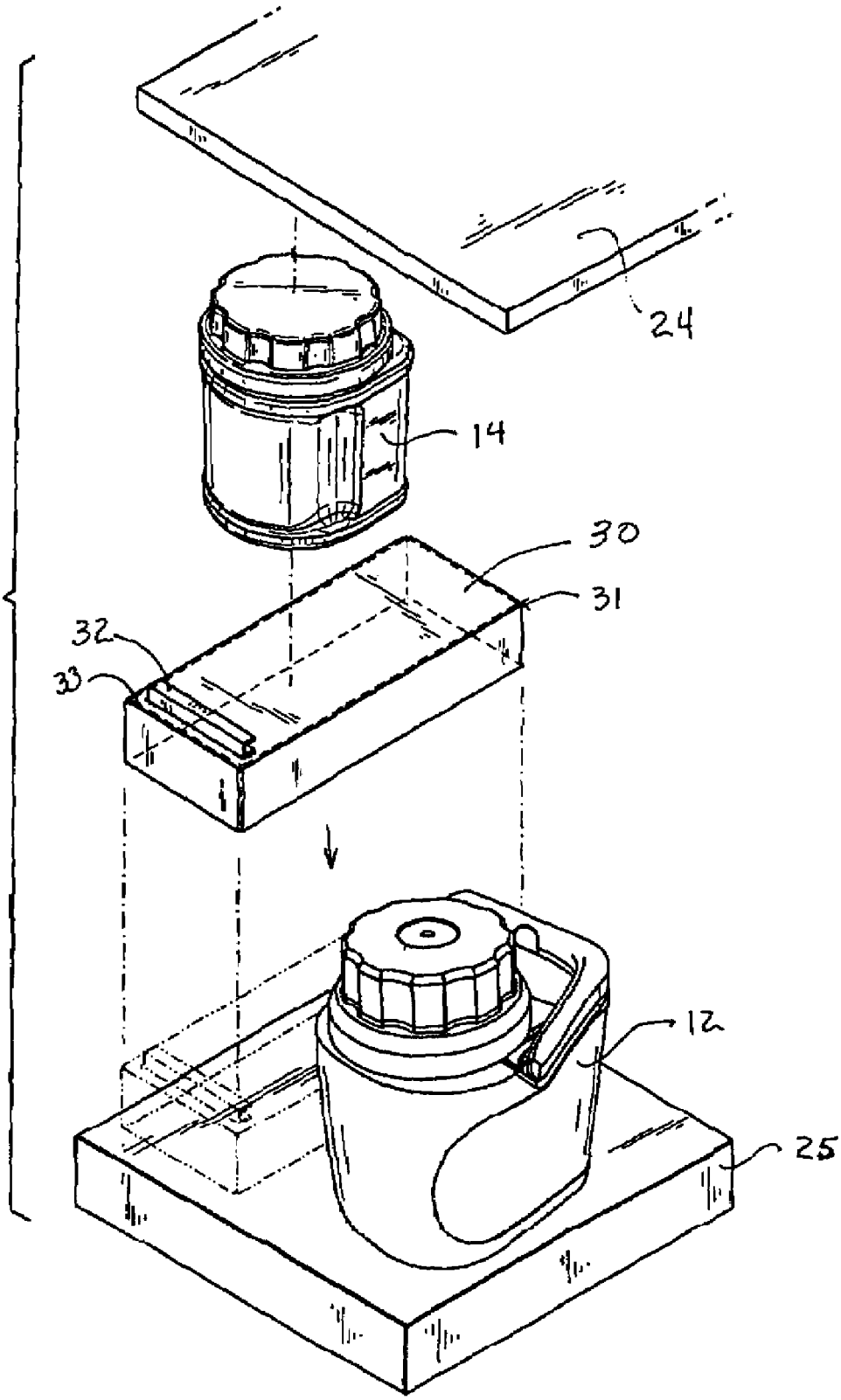
FIG. 5 is a partial perspective view of an exemplary embodiment of a system for holding and mixing containers and illustrating a platform configured to support a container adjacent to a second larger container in the holder of a paint mixer.

It is contemplated that the platform 30 can be sized to cover most of the holder 30 support member 25 as illustrated in FIGS. 2 and 4; or cover approximately one-half of the support member 25 as illustrated in FIG. 5; or cover one quadrant of the support member 25 (not shown). It is further contemplated that the height of the platform 30 may vary to accommodate various sized containers.

The platform 30 can be configured as illustrated in the figures, with solid sidewalls to support the planer upper member. However, a series of legs can also be used to support a planer upper member. The length of the legs can be used to adjust the height of the platform 30 and may be telescopic. The number of legs may vary to distribute the load of the containers and the pressure exerted by the plates 24 during the clamping process and the weight of the material, such as paint, in the containers 12, 14 being mixed.

The platform 30 is composed of a material selected from a group including a metal, a polyester resin, and a resilient material. The illustrated platform 30 is composed of metal such as aluminum or steel. The platform 30, depending on the material it is composed from, can be molded, machined or fabricated in any convenient and conventional manner.

To assist in placing containers on the platform 30, a stop 32 positioned proximate an edge 33 of the platform 30 is provided. The stop 32 can be composed of the same material as the platform 30 and attached to the platform 30 by any convenient and conventional means, for example, welding, adhesive, or fasteners. The stop 32 can be a single member having a u-shaped cross section as illustrated in FIGS. 3 and 4 or it can be a plurality of members extending at spaced positions approximate an edge 33 of the platform 30. It is also contemplated that a stop 32 can be placed in any one of the four edges 33 of the platform 30 and that several stops 32 can be placed at several or all of the edges 33 of the platform 30. The cross-sectional configuration of the stop 32 can be of any convenient shape.

It is important to note that the construction and arrangement of elements of the container holder platform of the system for holding and mixing as shown in the exemplary embodiments is illustrative only. Only a few embodiments have been described in detail in this disclosure, those skilled in the art who review this disclosure will readily appreciate that many modifications are possible (example variations in sizes, dimensions, structures, shapes and proportions to the various elements, value of parameters, mounting arrangements, use of materials, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or resequenced accorded to alternative embodiments. In the claims, any means-plus-function clause is intended to cover the structures described herein as performing the recited function in not only structural equivalent but also equivalent structures. Other substitutions, modifications, changes and omissions may be made in the design, operating conditions and arrangement of the exemplary embodiments without departing from the spirit of the present invention as expressed in the appended claims.

What is claimed is:

1. A system for holding and mixing paint containers, the system comprising:

a first container of paint having a first volume;

a second container of paint having a second volume less that the first volume;

a holder comprising a clamp having a plate configured to apply pressure to the first container;

a motor configured to move the holder about at least one axis; and a platform configured for being removably placed within the holder and configured to support the second container from below the second container, wherein the plate applies pressure to the first and second container during a single mixing operation.

2. The system of claim 1, wherein the holder is balanced for both the first container and the second container supported by the platform placed in the holder.

3. The system of claim 1, wherein the platform is configured to support at least four second containers.

4. The system of claim 1, wherein the platform includes a stop proximate an edge of the platform.

5. The system of claim 1, wherein the platform is composed of a material selected from a group consisting of a metal, a polyester resin, and a resilient material.

6. The system of claim 1, wherein the perimeter of the platform is less than the perimeter of the holder.

7. The system of claim 1, wherein the first container volume is one gallon (4 liters) and the second container volume is one quart (1 liter).

8. An apparatus for holding and mixing paint containers, the apparatus comprising:

a first container of paint having a first volume;

a second container of paint having a second volume less that the first volume;

a means for holding comprising a means for clamping to apply pressure to the first container;

a means for moving configured to move the means for holding about at least one axis; and a means for adjusting height configured for being removably placed within the means for holding and configured to support the second container from below the second container, wherein the means for clamping applies pressure to the first and second container during a single mixing operation.

9. The apparatus of claim 8, wherein the means for holding is balanced for both the first container and the second container supported by the means for adjusting height placed in the means for holding.

10. The apparatus of claim 8, wherein the means for adjusting height can support at least four second containers.

11. The apparatus of claim 8, wherein the means for adjusting height includes a means for stopping.

12. The apparatus of claim 8, wherein the perimeter of the means for adjusting height is less than the perimeter of the means for holding.

13. The apparatus of claim 8, wherein the first container volume is one gallon (4 liters) and the second container volume is one quart (1 liter).

14. An apparatus for holding and mixing paint containers, the apparatus comprising:

a first container of paint;

a different size second container of paint;

a holder comprising a clamp having a plate configured to apply pressure to the first and second containers;

a motor configured to move the holder about at least one axis; and a platform configured for removable placement within the holder below the second container, wherein the second container is positioned to allow the plate to apply pressure to both containers during a single mixing operation.

15. The system of claim 14, wherein the platform is configured to support at least four second containers.

16. The system of claim 14, wherein the platform includes a stop proximate an edge of the platform.

17. The system of claim 14, wherein the platform is composed of a material selected from a group consisting of a metal, a polyester resin, and a resilient material.

18. The system of claim 14, wherein the perimeter of the platform is less than the perimeter of the holder.

19. The system of claim 14, wherein the first container volume is one gallon (4 liters) and the second container volume is one quart (1 liter).

* * * * *